US008741126B2

(12) United States Patent
Demoment

(10) Patent No.: US 8,741,126 B2
(45) Date of Patent: Jun. 3, 2014

(54) AVIATION GASOLINE FOR AIRCRAFT PISTON ENGINES, PREPARATION PROCESS THEREOF

(75) Inventor: Pascale Demoment, Le Havre (FR)

(73) Assignee: Total Marketing Services, Puteaux (FR)

( * ) Notice: Subject to any disclaimer, the term of this patent is extended or adjusted under 35 U.S.C. 154(b) by 0 days.

(21) Appl. No.: 13/001,932

(22) PCT Filed: Jun. 29, 2009

(86) PCT No.: PCT/IB2009/006114

§ 371 (c)(1),
(2), (4) Date: Dec. 29, 2010

(87) PCT Pub. No.: WO2010/004395

PCT Pub. Date: Jan. 14, 2010

(65) Prior Publication Data

US 2011/0114536 A1 May 19, 2011

(30) Foreign Application Priority Data

Jun. 30, 2008 (FR) ..... 08 03654

(51) Int. Cl.
*C10L 1/04* (2006.01)
*C10L 1/06* (2006.01)

(52) U.S. Cl.
USPC ..... 208/16; 208/17; 44/300; 585/14

(58) Field of Classification Search
USPC ..... 208/16, 17; 44/300; 585/14
See application file for complete search history.

(56) References Cited

U.S. PATENT DOCUMENTS

| | | | | |
|---|---|---|---|---|
| 2,398,197 | A | 4/1946 | Stanly | |
| 4,412,847 | A | 11/1983 | Dolhyj et al. | |
| 4,647,292 | A | 3/1987 | Jessup et al. | |
| 5,032,144 | A | 7/1991 | Jessup et al. | |
| 5,609,653 | A | 3/1997 | Roman et al. | |
| 5,851,241 | A | 12/1998 | Studzinski et al. | |
| 6,238,446 | B1 * | 5/2001 | Henderson | 44/359 |
| 6,451,075 | B1 * | 9/2002 | Schoppe et al. | 44/454 |
| 6,767,372 | B2 * | 7/2004 | Barnes et al. | 44/300 |
| 7,416,568 | B2 * | 8/2008 | Clark | 44/300 |
| 7,553,404 | B2 * | 6/2009 | Clark et al. | 208/93 |
| 7,833,295 | B2 * | 11/2010 | Clark | 44/448 |
| 7,897,034 | B2 * | 3/2011 | De Oliveira et al. | 208/17 |
| 2002/0175107 | A1 * | 11/2002 | Huff et al. | 208/15 |
| 2003/0040650 | A1 * | 2/2003 | Butler et al. | 585/14 |
| 2003/0183554 | A1 | 10/2003 | Bazzani et al. | |
| 2004/0124122 | A1 * | 7/2004 | Clark | 208/15 |
| 2006/0052650 | A1 * | 3/2006 | Thebault et al. | 585/14 |
| 2006/0086040 | A1 | 4/2006 | De Oliveira | |
| 2006/0288635 | A1 | 12/2006 | Seyfried | |
| 2008/0172931 | A1 * | 7/2008 | Bazzani et al. | 44/447 |
| 2008/0178519 | A1 * | 7/2008 | Bazzani et al. | 44/300 |
| 2008/0244963 | A1 * | 10/2008 | Demoment et al. | 44/322 |
| 2008/0295388 | A1 * | 12/2008 | Bazzani et al. | 44/300 |
| 2010/0275508 | A1 | 11/2010 | Dolmazon et al. | |

FOREIGN PATENT DOCUMENTS

| | | | |
|---|---|---|---|
| DE | 197 44 109 | A1 | 4/1999 |
| EP | 0 474 342 | A1 | 3/1992 |
| EP | 0 540 297 | A1 | 5/1993 |
| EP | 0 609 089 | A1 | 8/1994 |
| EP | 0 697 033 | B1 | 2/1996 |
| EP | 0 910 617 | A1 | 4/1999 |
| EP | 0 948 584 | B1 | 10/1999 |
| EP | 1 224 247 | B1 | 7/2002 |
| EP | 1 359 207 | A1 | 11/2003 |
| FR | 2830259 | A1 | 4/2003 |
| FR | 2846003 | A1 | 4/2004 |
| FR | 2894976 | A1 | 6/2007 |
| GB | 520527 | A | 4/1940 |
| GB | 2114596 | A | 8/1983 |
| WO | 97/44413 | A1 | 11/1997 |
| WO | 00/77130 | A1 | 12/2000 |
| WO | 02/22766 | A1 | 3/2002 |
| WO | 2004/037952 | A1 | 5/2004 |
| WO | 2004/044106 | A1 | 5/2004 |

OTHER PUBLICATIONS

International Search Report for PCT/IB2009/006114, ISA/EP, Rijswijk, NL, mailed Nov. 13, 2009.
French Search Report for priority document FR 0803654, issued Feb. 3, 2009.
Third party observations to Patent Application 09794052.2, Publication No. EP2303997A1, WO 2010/004395, Aviation Gasoline for Aircraft. Dated Jan. 19, 2012. 17 pgs.
Jones, Edwin K., Advances in Catalyses and Related Subjects vol. X, p. 176; Library of Congress No. 49/7755. (1958). 1 pg.
Strauss, Kurt H., Aviation Fuels, p. 3; Significant Tests for Petroleum Products, 7th Edition; ASTM (2003). 1 pg.
Wiedling, Sten et al., Royal Institute of Technology, Cover page and Sections 4.2 and 4.3 of a May 27, 1992 Report. 2 pgs.
Hjelmco Oil AB, AVGAS MSDS form; dated Dec. 27, 2005. 2 pgs.
Email from Hjelmco Oil to Kerstin Harvenberg, dated Jan. 19, 2006. 1 pg.
Hjelmco Oil AB, AVGAS MSDS form, dated Feb. 25, 2011. 1 pg.
Chevron, San Renon California; AVGAS MSDS form; dated Mar. 24, 2001. 1 pg.
Selkirk College IATPL Program Manual, Appendix 7-1, Aviation Fuel Safety Data Sheet, date illegible. 1 pg.
Chevron, AVGAS MSDS form; dated Oct. 8, 2003. 1 pg.
Chevron, AVGAS MSDS form; dated Feb. 26, 2008. 1 pg.
Chevron, AVGAS MSDS form; dated May 4, 1993. 2 pgs.
Total UK Ltd., AVGAS MSDS form; dated Jan. 25, 2008. 1 pg.
Hjelmco Oil, AVGAS MSDS form; dated Feb. 25, 2011. 1 pg.
Kemi, Acknowledgement List, dated Dec. 27, 1994. 1 pg.
Lycoming, Service Instruction; dated Apr. 18, 2008. 1 pg.
Lycoming, Service Instruction; dated Jun. 14, 2006. 1 pg.

(Continued)

*Primary Examiner* — Ellen McAvoy
(74) *Attorney, Agent, or Firm* — Harness, Dickey & Pierce, P.L.C.

(57) ABSTRACT

The subject of the present disclosure is an aviation gasoline composition that is lead-free and free of oxygenated compounds meeting the specifications of the ASTM standard comprising isopentane, isooctane, and (alkyl)aromatics. The aviation gasoline composition according to the disclosure may be obtained simply and economically from a mixture of hydrocarbon bases usually available in a refinery.

9 Claims, 12 Drawing Sheets

(56) References Cited

OTHER PUBLICATIONS

Figure 1:
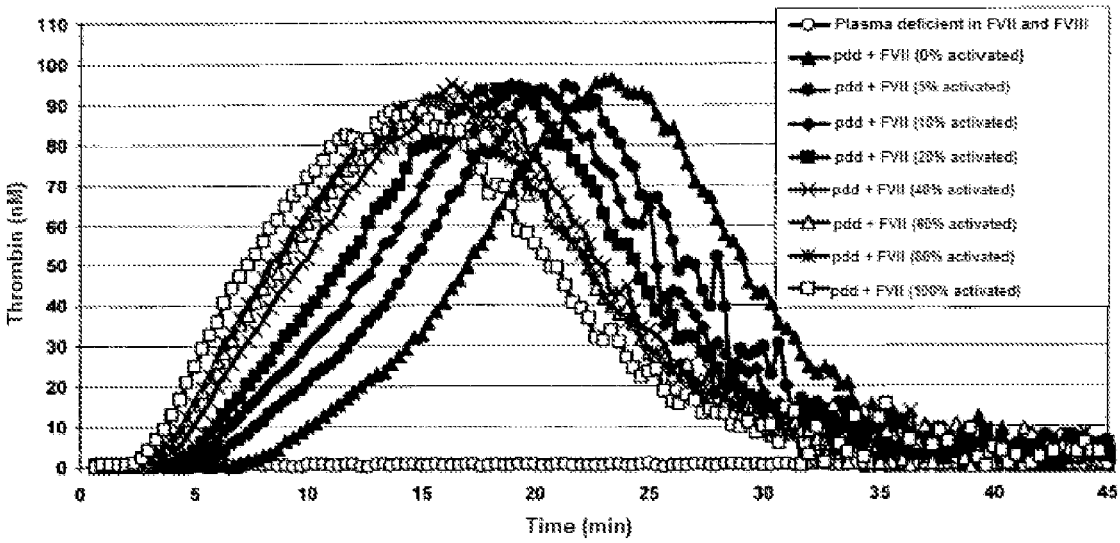
Figure 2:
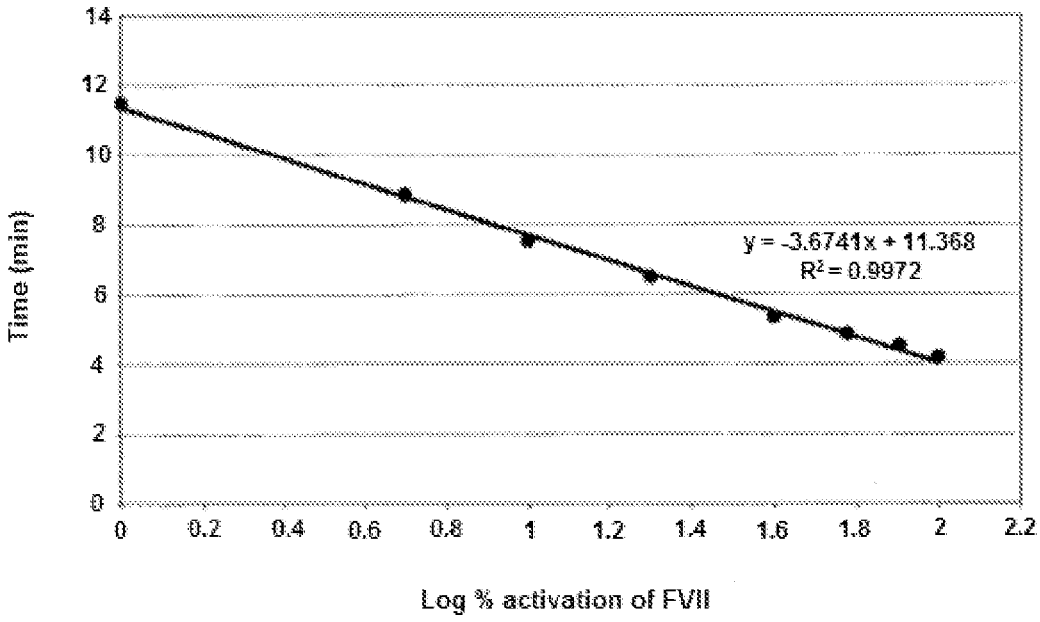
Figure 2A:
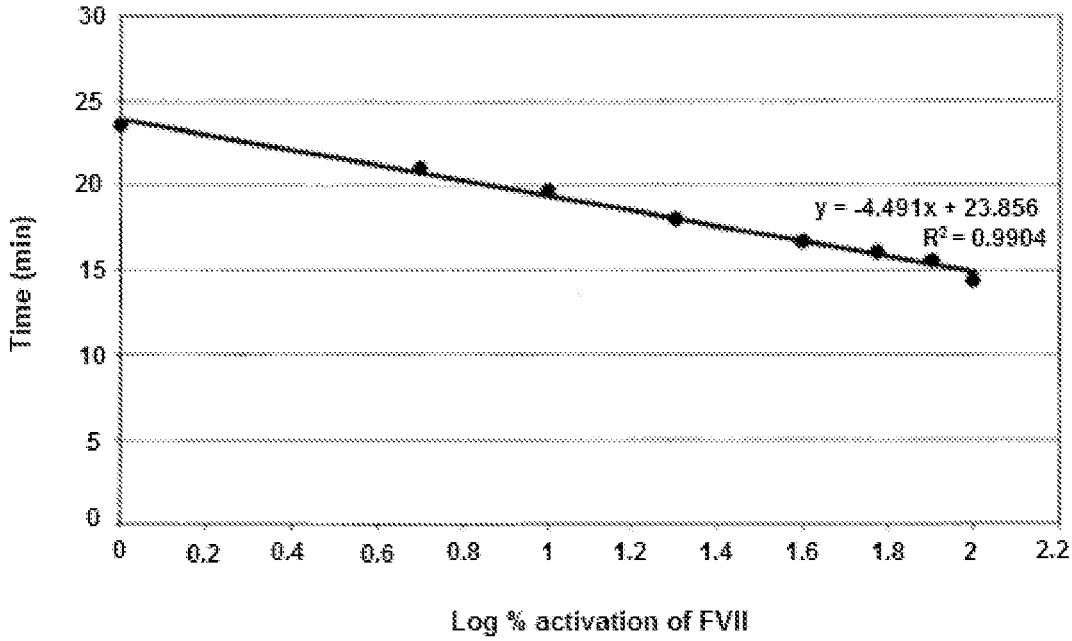
Figure 3:
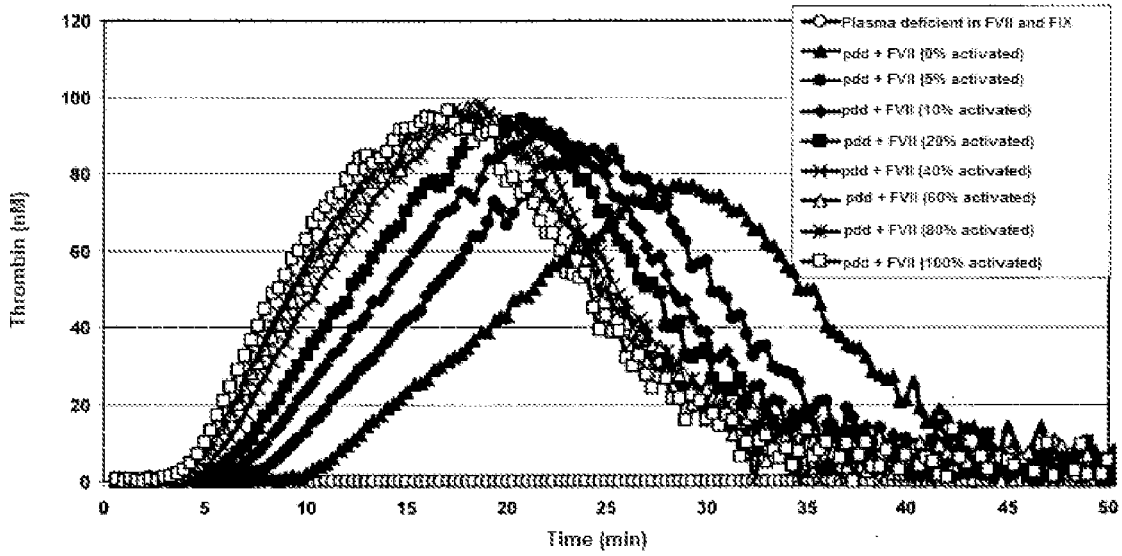
Figure 4:
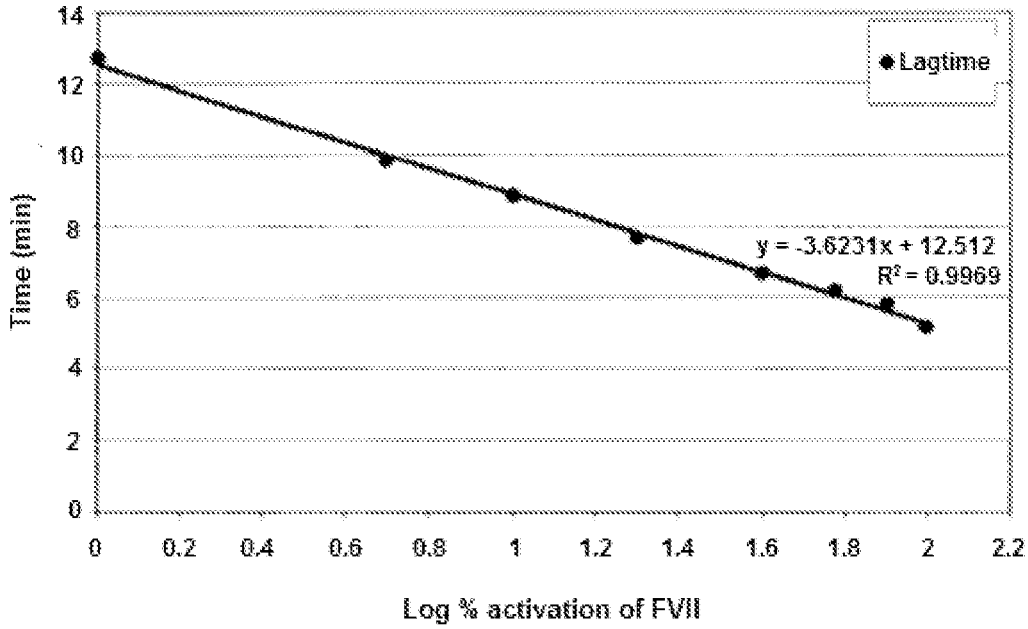
Figure 5:
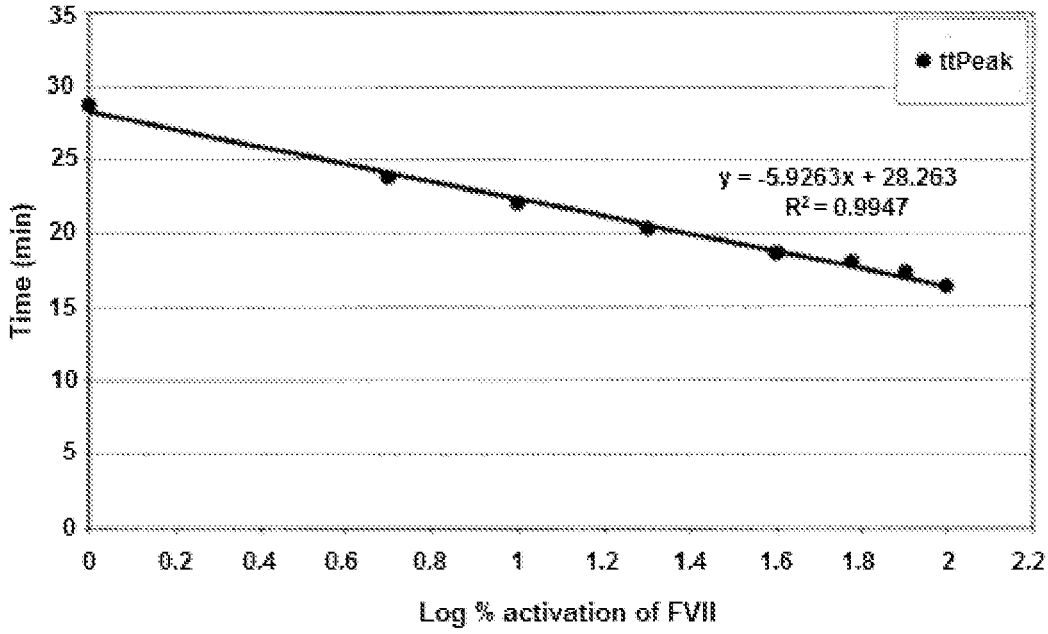
Figure 6:
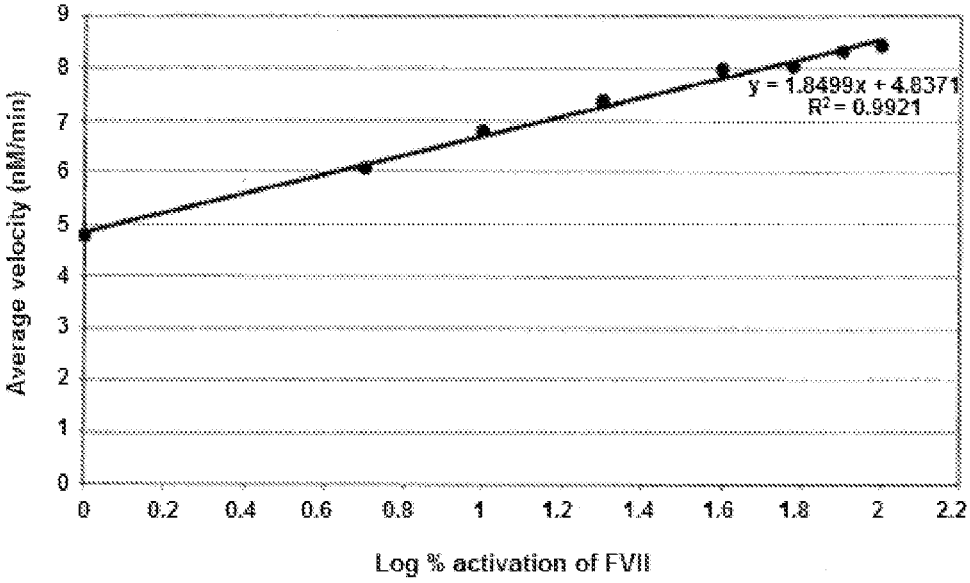
Figure 7:
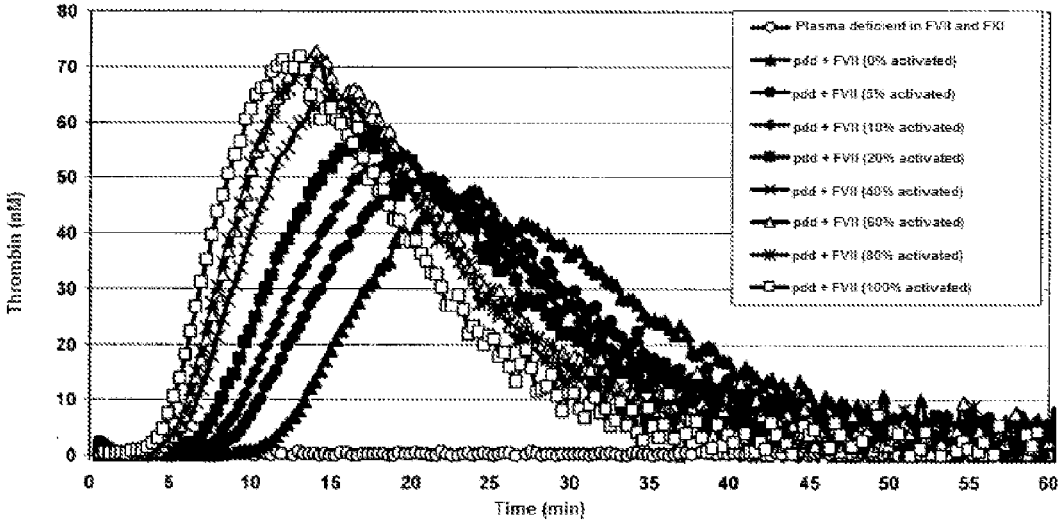
Figure 8:
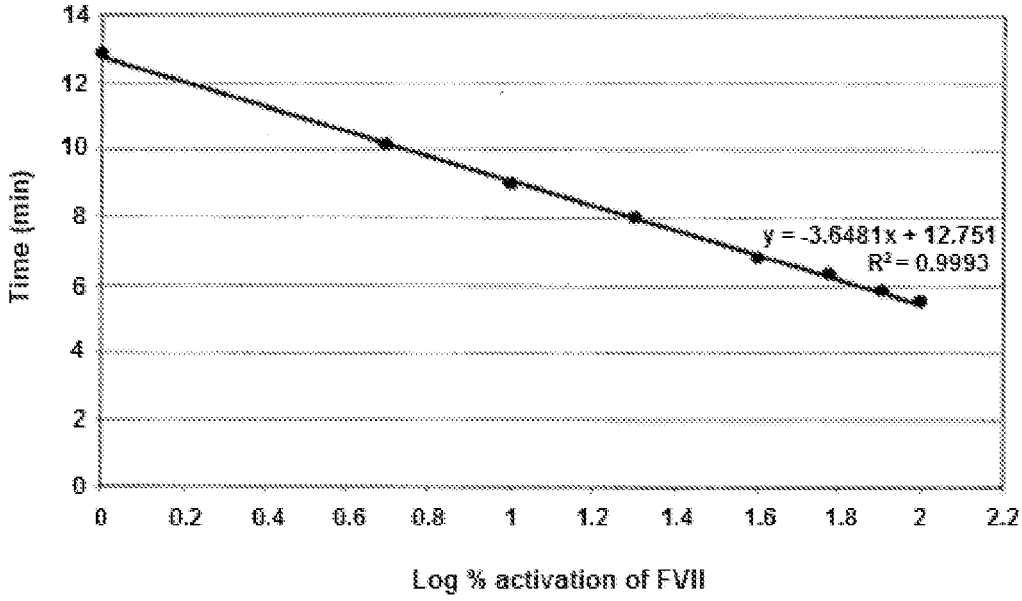
Figure 9:
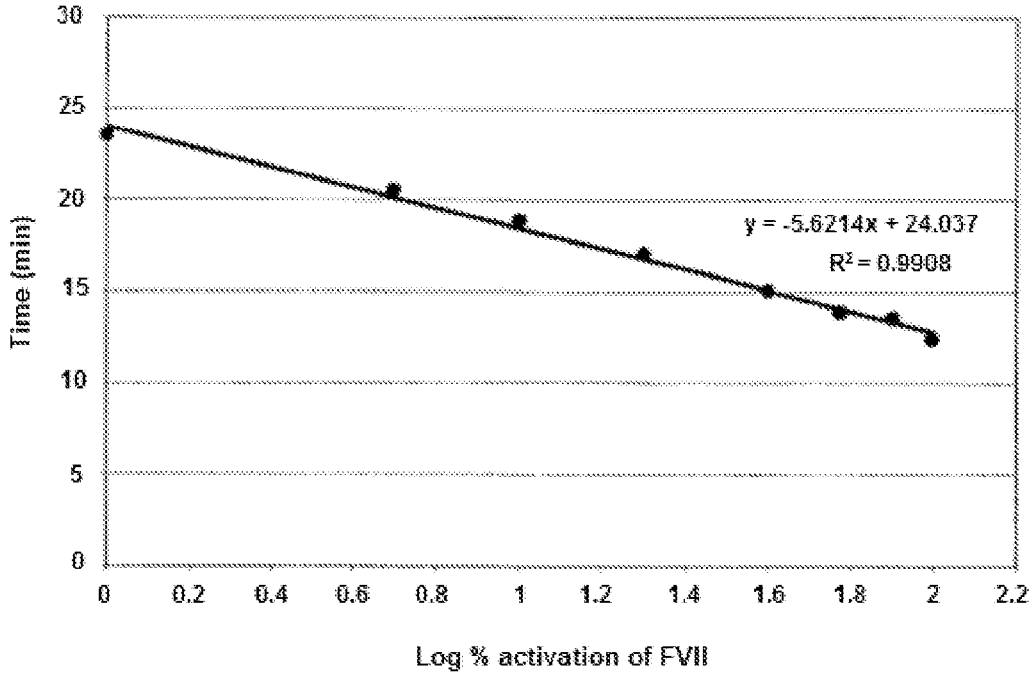
Figure 10:
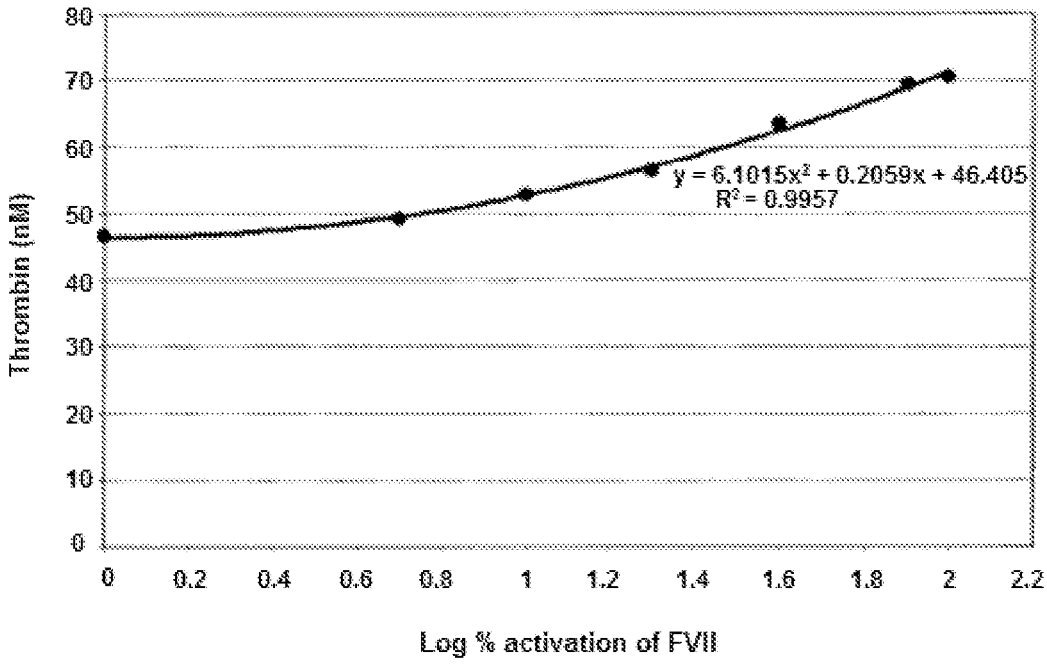
Figure 11:
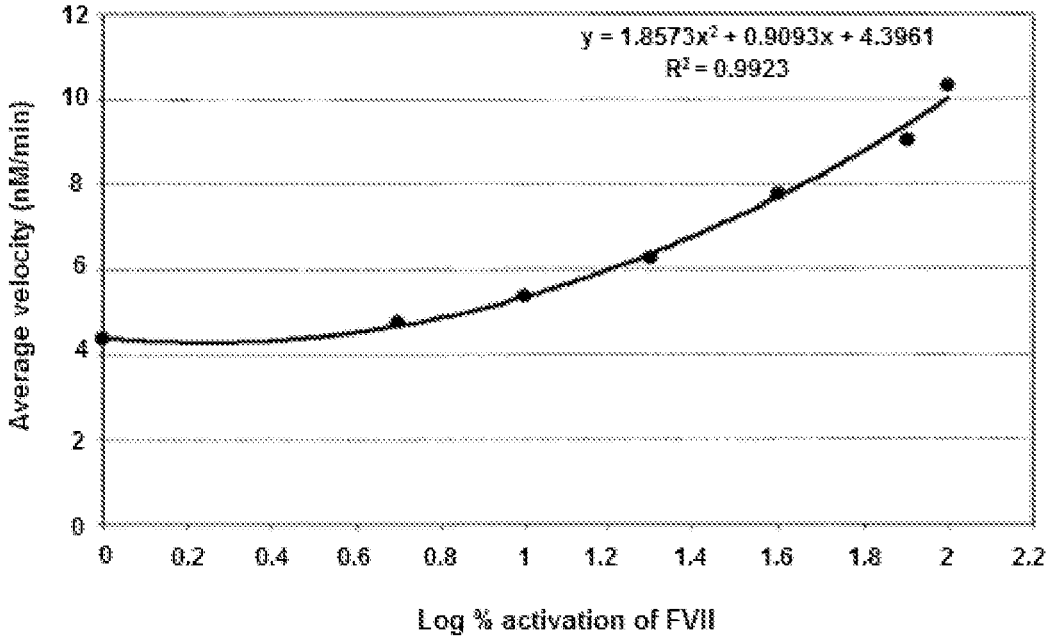
Figure 12:
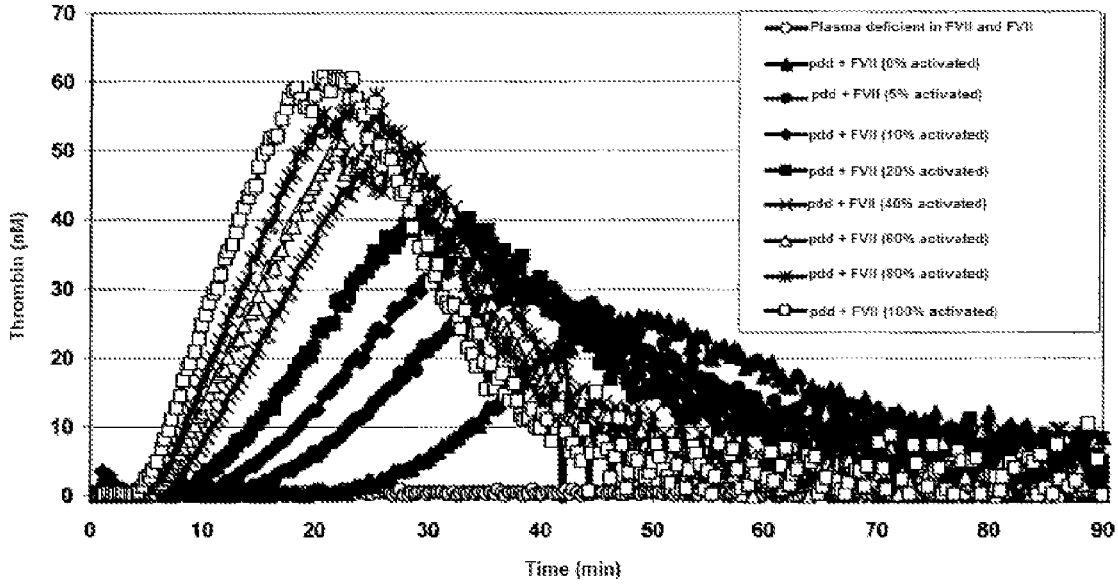
Figure 13:
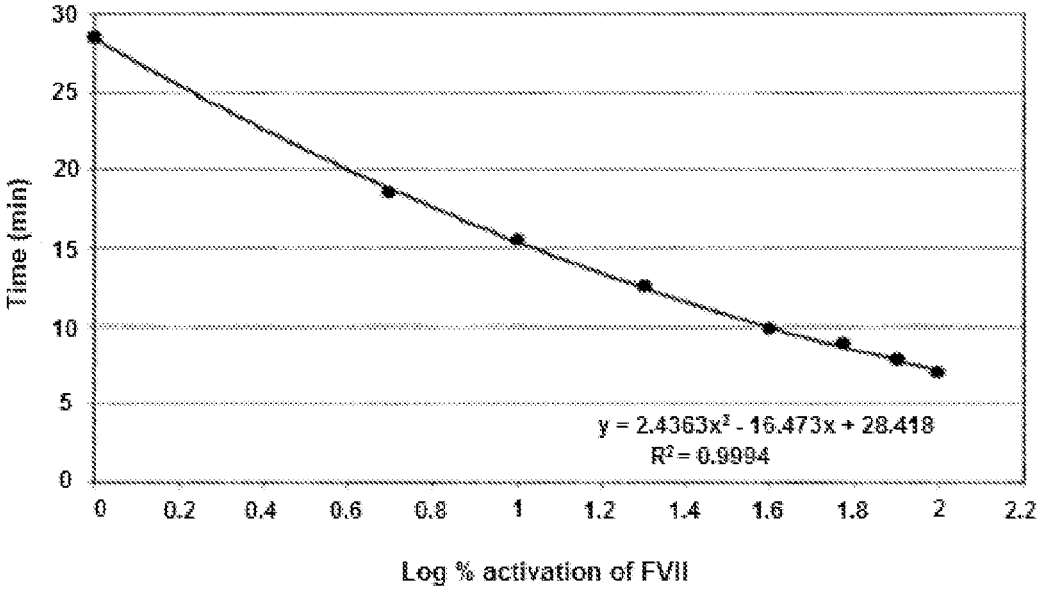
Figure 14:
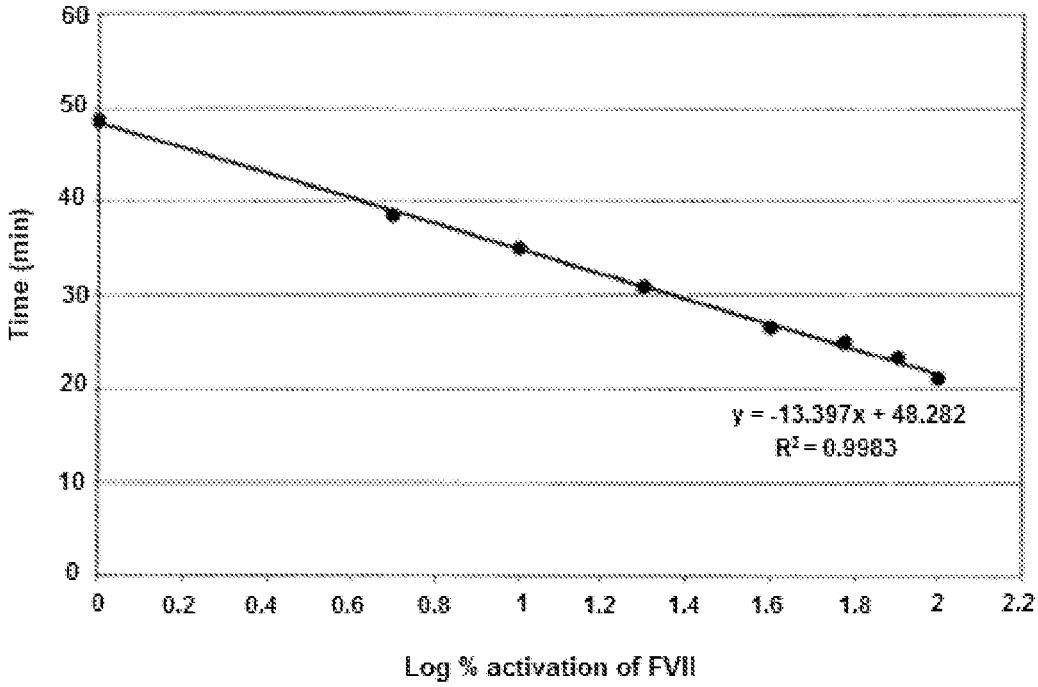
Figure 15:
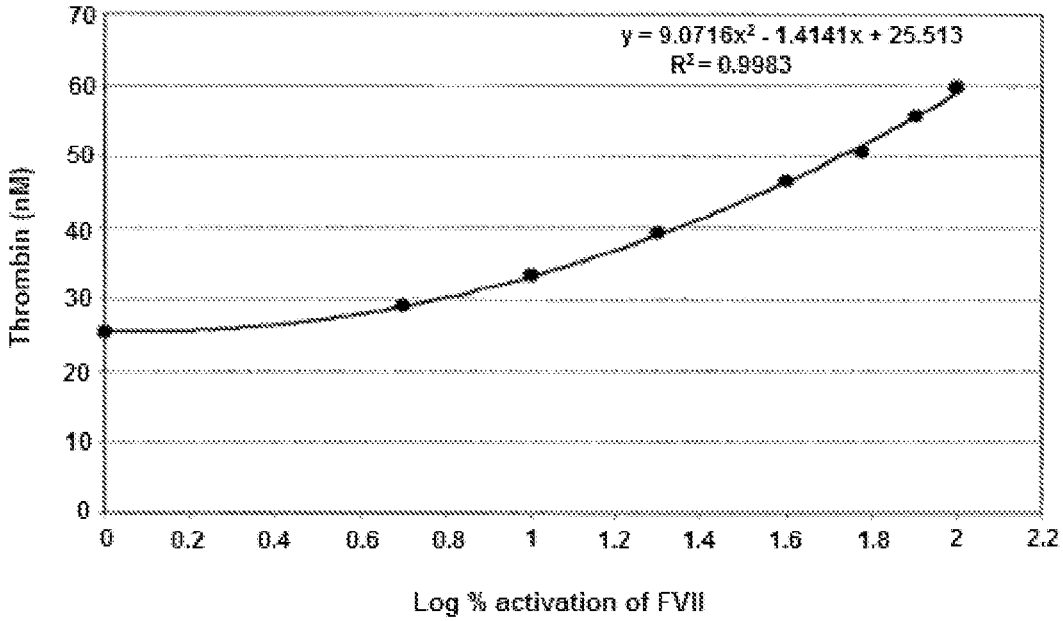
Figure 16:
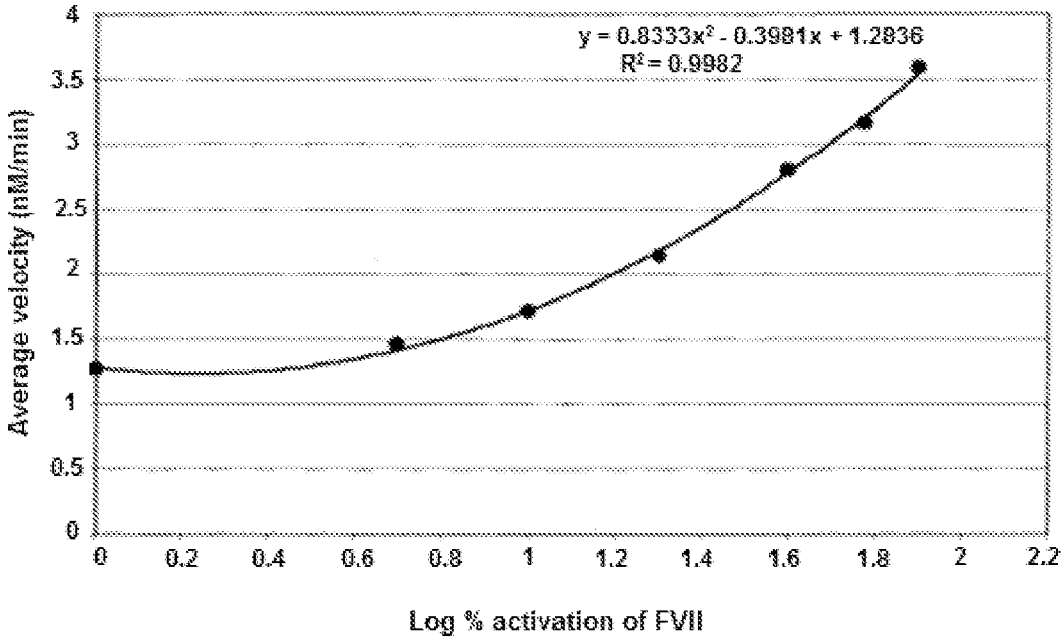
Figure 17:
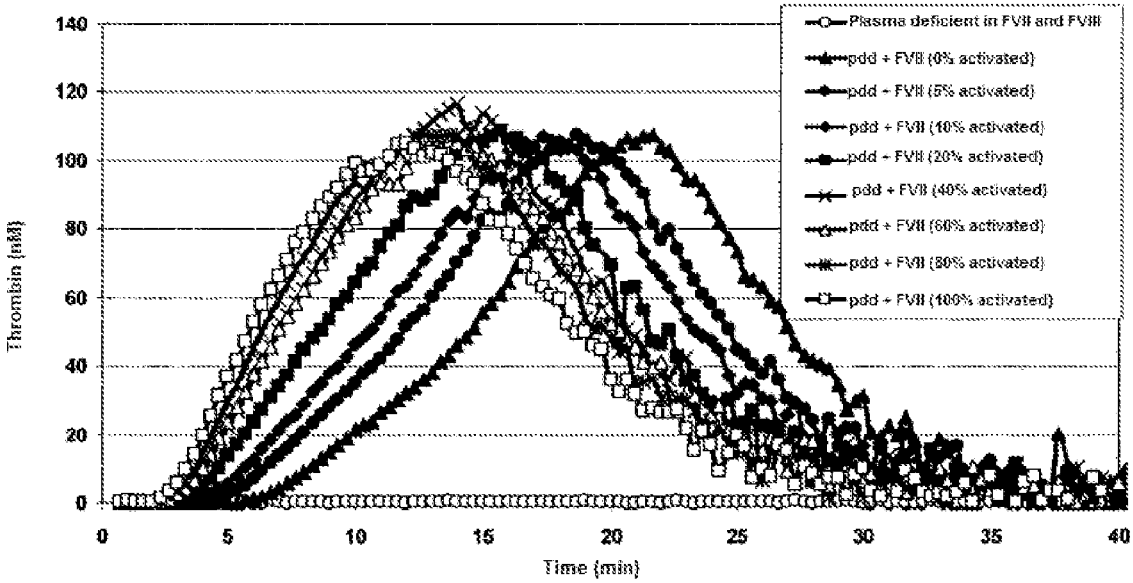
Figure 18:
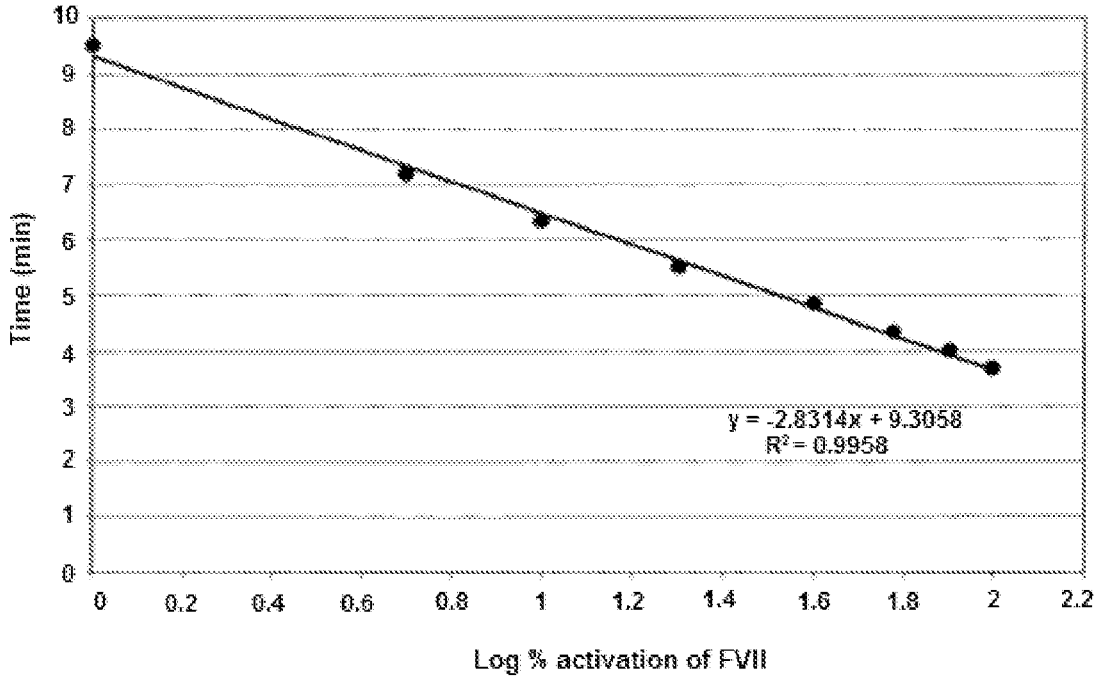
Figure 19:
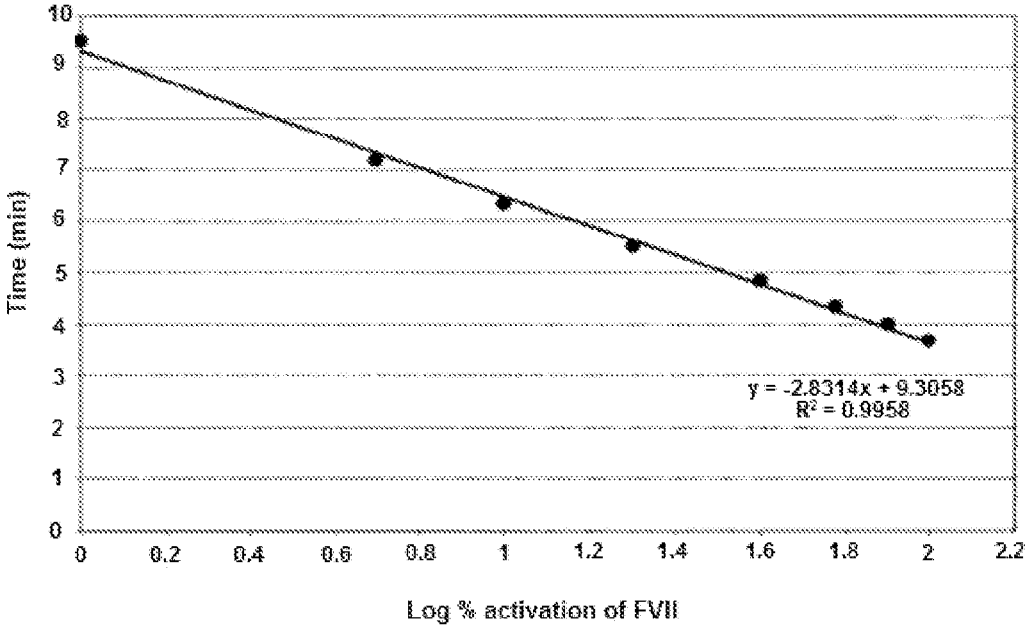
Figure 20:
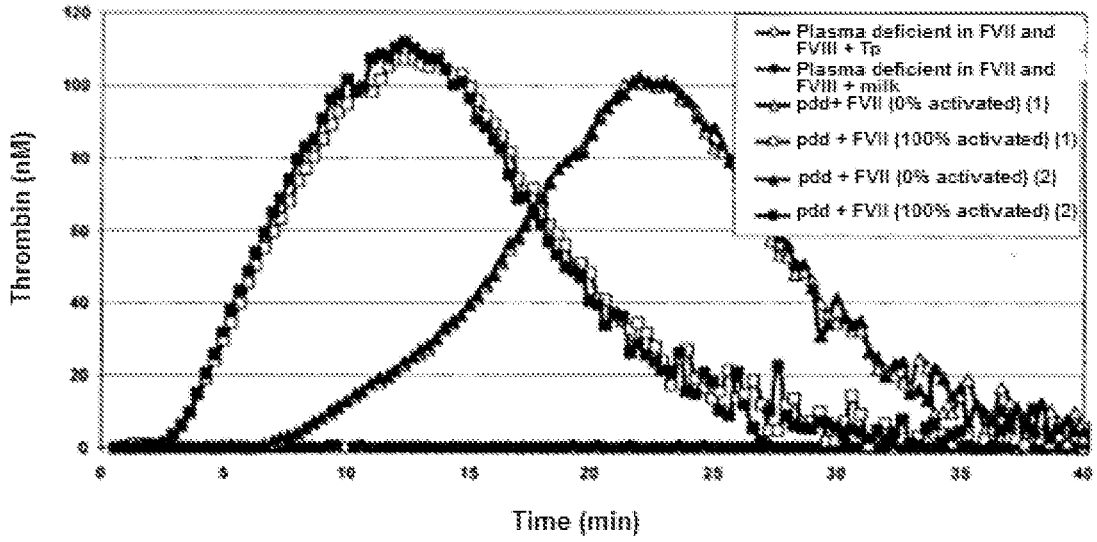
Figure 21:
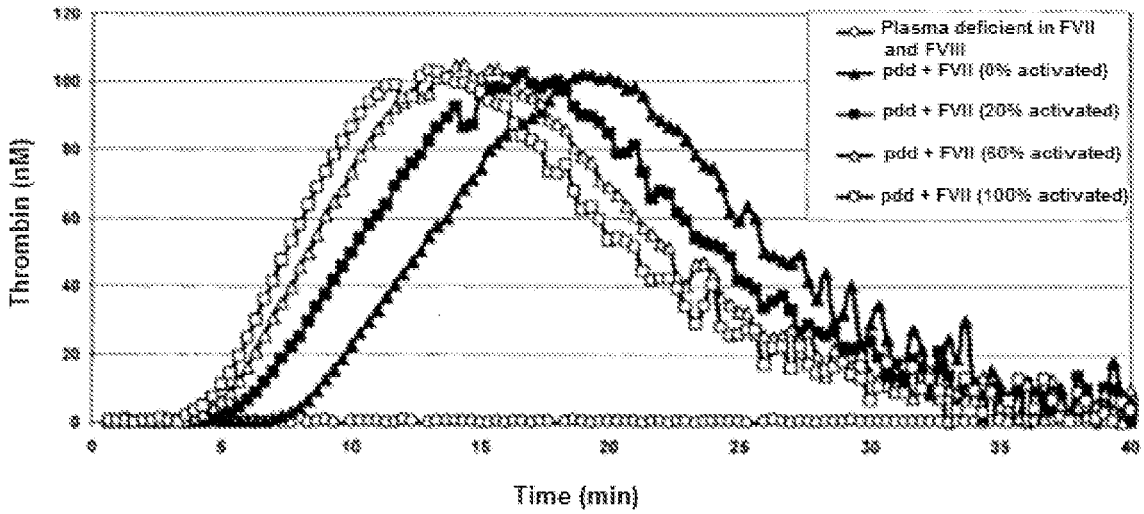
Figure 22:
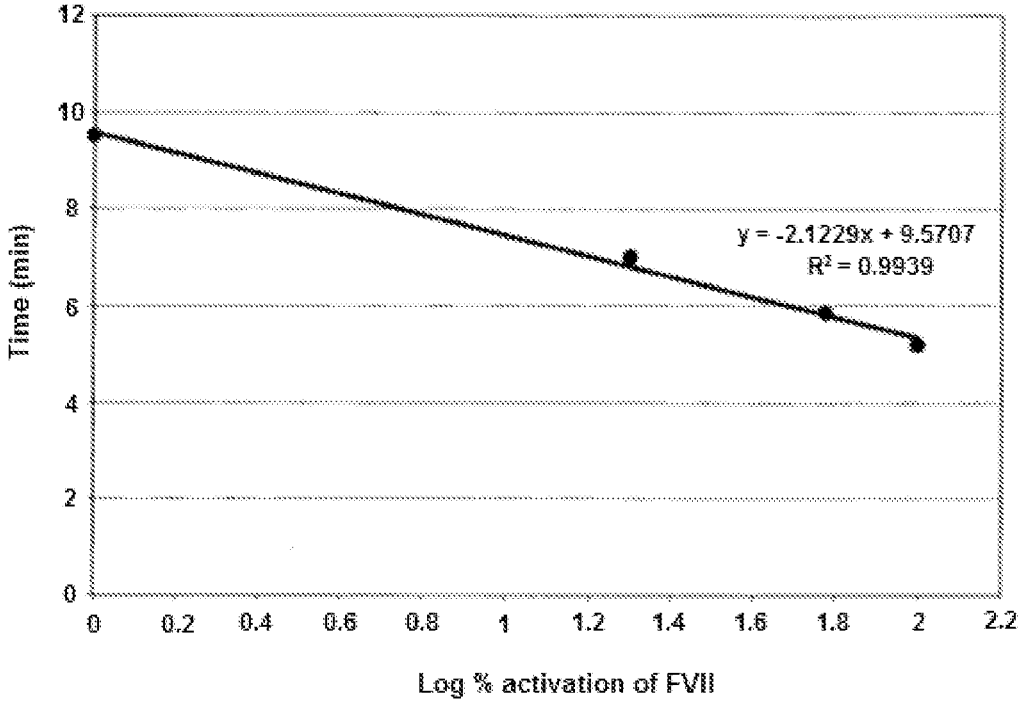
Figure 23:
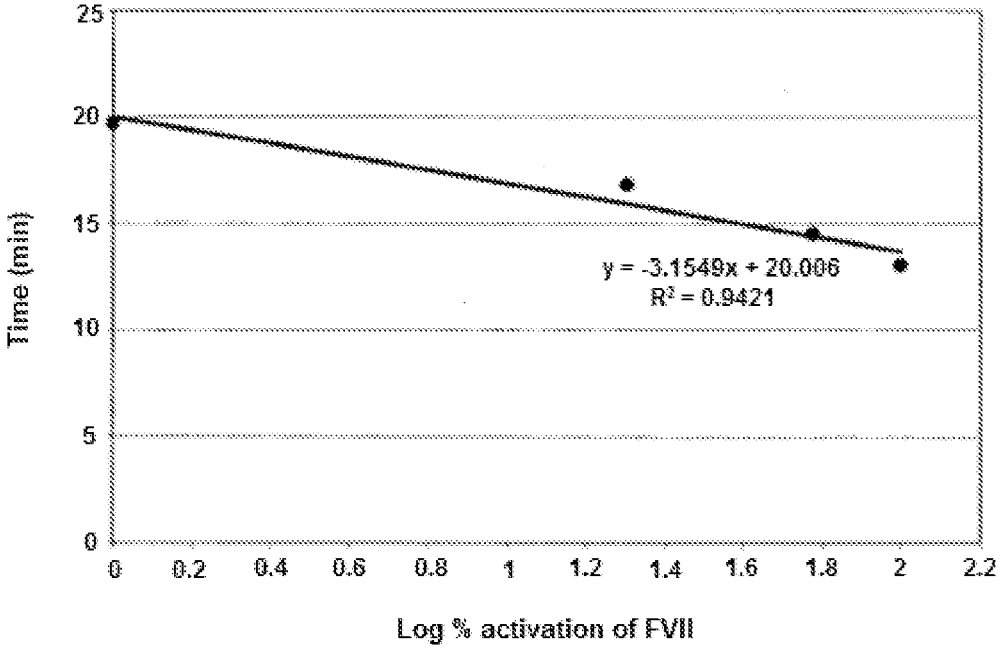

Lycoming, Service Instruction; dated Jan. 20, 1995. 1 pg.
Email Correspondence from Eric Johansson to Hjelmco Oil with 2 page attachment; dated Mar. 28, 2006. 3 pgs.
Hjelmco Oil, AVGAS MSDS form; dated Dec. 27, 2005. 1 pg.
ASTM Standard Specification for Aviation Gasolines, pp. 405-408. Date unknown. 4 pgs.
Neste Oil, AVGAS Test Sample; dated Aug. 19, 1993. 1 pg.
CSM Materialteknik Report dated Feb. 18, 1997. 2 pgs.
Hjelmco Oil Report dated Jan. 2, 2006. 3 pgs.
Military Specification MIL-G-5572C; dated Jun. 30, 1960. 6 pgs.
Hjelmco Oil Presentation dated 2004. 5 pgs.
Workshop on Piston Engines Emissions, Report dated May 6, 2003. 2 pgs.
Proceedings of the Second International Conference on Alternative Aviation Fuels, Final Report dated Mar. 1999. 2 pgs.
Hjelmco Oil AB, Notice to AVGAS Customers; dated Oct. 17, 1997. 3 pgs.
Pilot Magazine Excerpt, Issue NC48-49/2002. 5 pgs.
Aerokurier Magazine Article; Issue 11/98 pp. 26-27. 2 pgs.
General Aviation, "The Green Machine" dated Feb. 2007. 1 pg.

* cited by examiner

AVIATION GASOLINE FOR AIRCRAFT PISTON ENGINES, PREPARATION PROCESS THEREOF

FIELD OF THE INVENTION

The present invention relates to a lead-free aviation gasoline composition (AVGAS) and free of an oxygenated compound, intended for aircraft with piston or reciprocating engines. In particular, the object of the present invention is lead-free aviation gasoline with an octane number MON (Motor Octane Number) F2 greater than or equal to 91 and having very good combustion characteristics.

TECHNOLOGICAL BACKGROUND

Aviation gasoline is a product which is elaborated with care and subject to severe regulations, which go hand-in-hand with any aeronautical application. Thus, the preparation in a refinery of aviation gasoline is carried out with bases characterized by both a narrow distillation interval and high octane numbers. These bases generally consist of alkylates, reformates and/or isopentane cuts, the latter being used in a low concentration because of their high volatility.

But prior to their marketing, aviation gasoline should satisfy other specific physico-chemical characteristics, defined by international specifications. Thus aviation gasolines should have

- a low vapor pressure (less than 490 mbars) in order to avoid vaporization problems (vapor lock) or risks of icing increased by the low temperatures encountered in altitude;
- a final distillation point of less 170° C., in order to limit formations of deposits and their harmful consequences (power losses, deteriorated cooling);
- good cold strength (absence of crystals down to −58° C.) in order to prevent any blocking of the filters and conduits in altitude;
- a low sulfur content, presently limited to 0.05% by weight, all these characteristics being grouped in the ASTM D 910-07 standard in effect at the filing date of the present application.

Aviation gasolines are used on engines having good performances and frequently operating under a high load, i.e. under conditions close to pinking. It is therefore required that this type of fuel have very good resistance to self-ignition.

For aviation gasoline, the motor octane number or MON is determined relatively to the operation with a slightly lean mixture (cruising speed). With the purpose of guaranteeing this high octane requirement, the refiner generally proceeds at the stage of the making of aviation gasoline, with the addition of a organolead compound, and more particularly tetraethyl lead (TEL). Now, like for gasolines for land vehicles, government authorities tend to lower the lead content, or even to suppress this additive, because of its noxious character for the environment and health. Thus, firstly, reduction and then elimination of lead from the composition of aviation gasoline become a goal to be attained in the short and then in the medium term.

The use of additives as a replacement for lead compounds in order to improve the octane number, is well-known for land vehicle gasolines, such as in patents EP 474 342, GB 2,114,596, U.S. Pat. No. 5,032,144 or U.S. Pat. No. 4,647,292. Insofar aviation gasoline is subject to much more severe regulations than gasoline for land vehicles, for reasons of reliability and safety of operation during the taking-off phase and in altitude, it is not obvious to use these additives for aviation gasoline, for which the constraints are much stricter than those required for automotive gasolines.

As regards aviation gasoline, in order to replace the lead additives, solutions have been proposed in the literature, such as by adding other additives or components, such as aromatic amines, for example aniline, alkylaniline, methylcyclopentadienyl manganese tricarbonyl (MMT).

EP 540 297 and EP 609 089 propose adding methylcyclopentadienyl manganese tricarbonyl (MMT) to aviation gasoline as a substitute for lead.

In EP 609 089 lead-free aviation gasolines are described, based on alkylates, in which an ether is added, such as ETBE or MTBE, as well 0.4 to 0.5 g/gallon of manganese in the form of the cyclopentadienyl manganese tricarbonyl compound. The problem of the invention was not discussed since the described gasoline is not a base of the AVGAS type: it comprises alkylates, but does not comprise reformates, or isomerates.

In EP 697 033, a lead-free aviation gasoline is described consisting of isopentane, alkylate, toluene, with a MON comprised between 90 and 93, additived with 4 to 20% of an aromatic amine in order to obtain a gasoline with an MON greater than or equal to 98.

EP 910 617 describes a mixture of aromatic amine and alkyltertiobutyl ether, and optionally of a manganese compound which is added to the alkylate with a wide boiling range, forming aviation gasoline.

In WO 02/22766 a lead-free aviation gasoline is described, comprising a hydrocarbon compound which may be triptane associated with at least one liquid, saturated, aliphatic hydrocarbon compound (4 to 10° C.) and further comprising an alkyl ether (the thereby obtained base is not an AVGAS base).

Even if these additives lead to an increase in the octane number, this increase sometimes remains insufficient. Further, addition of these additives does not always meet the other requirements specific to aviation gasoline, such as heating value, vapor pressure and distillation range.

Moreover, these different additives are not always compatible with being respectful to the environment. For example, aromatic amines widely used for improving the octane number are all classified as toxic substances, in the case of absorption by inhalation or ingestion and especially on the skin. Methycyclopentadienyl manganese tricarbonyl (MMT) is as for it indexed by EPA as an air pollutant, which may represent potential risks for humans. Oxygenated compounds are presently not allowed in aviation gasoline compositions.

This is why other additive-free technical solutions have been proposed:

EP 948 584 proposes an aviation gasoline with a MON above 98 which contains at least 30% by volume of triptane and/or of 2,2,3-trimethylpentane.

EP 1 359 207 describes a lead-free automotive gasoline composition with an MON between 80 and 98 containing from 5 to 25% by volume of triptane and/or of 2,2,3-trimethylpentane, from 5 to 15% of olefins, from 15 to 35% of aromatics and 40 to 65% of $C_4$-$C_{12}$ paraffins.

EP 1 224 247 describes a lead-free gasoline which may notably be used as an aviation gasoline with an MON of at least 80, with a RON comprised between 90 and 115 containing a $C_8$-$C_{12}$ alkane with at least 4 methyl and/or ethyl branches. Preferably, the preferred gasoline further comprises triptane and/or 2,2,3-trimethylpentane.

Now the addition in a significant amount of compounds such as triptane and/or 2,2,3-trimethylpentane or alkanes with at least 4 branches which are a very small minority in usual oil bases stemming from refineries, and not only requires costly separation and purification processes for synthesizing these compounds but also generates for the refiner additional technical difficulties for storage and logistics for these compounds generating costs above those generally obtained for formulating conventional aviation gasoline from a mixture of hydrocarbon bases usually available in refineries.

WO 04/044106 describes lead-free aviation gases compositions with an MON ranging from 92 to 98 and containing from 10 to 90% by volume of at least one trimethylpentane and at least one $C_4$-$C_5$ paraffin. An example of a gasoline composition according to the invention with an MON of 95 comprises 59% isooctane, 8% toluene, 16% isopentane, 24% by volume of alkylate and 16% of alkylate fraction other than isooctane.

DE 197 44 109 describes a lead-free gasoline composition for 2- and 4-stroke engines comprising 70-85% by volume of $C_8$ isoparaffins, 17-19% by volume of $C_5$ isoparaffins, 2-4% of $C_6$ isoparaffins and preferably not more than 0.5% of aromatics and 0.1% of benzene. This reference does not specify whether this gasoline is suitable as an aviation gasoline.

SUMMARY OF THE INVENTION

In order to meet these needs for a lead-free aviation gasoline of the AVGAS type and without any oxygenated compound, the invention therefore aims at a novel lead-free aviation gasoline composition, intended for aircraft with piston or reciprocating engines, made from hydrocarbon bases generally available in an oil refinery, having a high octane number. The invention is notably directed to aviation gasolines for which the LHV (low heating value) characteristics, vapor pressure (VP) and distillation cut characteristics, observe the specifications retained for aviation gasoline grades as described in the ASTM D910-07 standard, except for the lead content and the engine performances.

For this purpose, the object of the invention is a lead-free aviation gasoline composition without any oxygenated compound, comprising from 10 to 22% by volume of isopentane, from 30 to 44% by volume of isooctane, from 1.8 to 20% by volume of aromatics including 1 to 10% by volume of toluene, and not containing more than 1% by volume of triptane, not more than 4% by volume of 2,2,3-trimethylpentane.

The aviation gasoline composition according to the invention may be obtained in a simple and economical way from a mixture of hydrocarbon bases usually available in refineries.

This composition has the following features:

an MON greater than or equal to 91, preferably greater than or equal to 92, and less than or equal to 95, an RON (research octane number) greater than or equal to 95, preferably greater than or equal to 96, advantageously greater than or equal to 98, and less than or equal to 100, a HV greater than or equal to 43.4, preferably greater than or equal to 43.5, and advantageously greater than or equal to 43.53 MJ/kg.

a vapor pressure at 37.8° C. preferably varying from between 38 and 49 kPa, preferably between 38.6 and 48.4 kPa.

DETAILED DESCRIPTION OF THE INVENTION

The first object of the invention is a lead-free aviation gasoline composition without any oxygenated compound, which comprises from 10 to 22% by volume of isopentane (2-methyl butane), from 30 to 44% by volume of isooctane (2,2,4-trimethylpentane), from 1.8 to 20% by volume of aromatics including 1 to 10% by volume of toluene, and containing not more than 1% by volume of triptane (2,2,3-trimethylbutane) and not more than 4% by volume of 2,2,3-trimethylpentane.

This composition has an MON greater than or equal to 91, preferably greater than or equal to 92, and less than or equal to 95, an RON greater than or equal to 95, preferably greater than or equal to 96, advantageously greater than or equal to 98, and less than or equal to 100, an HV greater than or equal to 43.4, preferably greater than or equal to 43.5 and advantageously greater than or equal to 43.53 MJ/kg, a vapor pressure at 37.8° C. preferably varying from between 38 and 49 kPa, preferably between 38.6 and 48.4 kPa.

In the sense of the present invention, by gasoline without any oxygenated compound is meant aviation gasoline not containing any oxygenated compound of the alcohol, ester or ether type, except for isopropanol which may be used as an anti-icing agent in an amount less than or equal to 1% of the total volume of the gases.

Preferably, the aviation gasoline composition according to the invention comprises from 14 to 22% by volume of isopentane, from 30 to 40% by volume of isooctane, from 8 to 20% by volume of aromatics, including preferably from 4 to 9% by volume of toluene.

More advantageously, the aviation gasoline composition according to the invention comprises from 20 to 22% by volume of isopentane, from 30 to 32% by volume of isooctane, preferably from 31 to 32%, from 15 to 18% by volume of aromatics, preferably including from 7 to 9% by volume of toluene.

The object of the invention is also a method for preparing the composition defined earlier.

The method according to the invention consists of mixing at least one isopentane cut B1, at least one base of the aviation alkylate type B2 and at least one base of the aviation reformate type B3.

The isopentane cuts and the aviation alkylate, aviation reformate bases are hydrocarbon bases easily available in refineries.

The method according to the invention consists of mixing.

10 to 20% by volume of at least one isopentane cut B1, which is a light base belonging to the family of the paraffinic hydrocarbons essentially consisting of $C_4$ and/or $C_5$ isoparaffins and preferably comprising at least 80% by volume, advantageously at least 90% by volume of $C_4$ and/or $C_5$ isoparaffins. According to a preferred embodiment, the base B1 comprises at least 90% by volume of isopentane, and advantageously at least 95%; the isopentane bases B1 generally do not contain more than 1% by volume of olefins; these light paraffinic bases may for example stem from the lightest factions of distillate produced by atmospheric distillation of crude oil and/or from alkane isomerization units;

62 to 88% by volume of at least one aviation alkylate base B2 essentially consisting of isoparaffins comprising 6 to 9 carbon atoms and preferably at least 90% by volume of isoparaffins comprising 6 to 9 carbon atoms; aviation alkylates generally comprise at least 95%, preferably at least 98.5% by volume of isoparaffins, including at least 65%, preferably at least 70%, and advantageously at least 80% by volume of $C_8$ isoparaffins; according to a preferred embodiment, the alkylate bases B2 comprise at least 45%, preferably at least 48% by volume of isooctane, and advantageously at least 30%, preferably at least 34% by volume of the other $C_8$ isoparaffins; these aviation alkylate bases may stem from different processes for treating crude oil, generally present in refineries; the bases B2 generally stem from the process for alkylation of isobutane with light olefins;

1 to 22% by volume of at least one base of the aviation reformate type B3 essentially consisting of (alkyl)aromatics (or simply aromatics); the reformate bases generally stem from the reforming of direct distillation gasoline and isopentane; aviation reformates generally consist of a hydrocarbon cut containing at least 70%, preferably at least 85%, by volume of aromatics comprising toluene (generally from 35 to 75%, preferably 45 to 70% by volume), of $C_8$ alkylaromatics (generally from 15 to 50% by weight of ethylbenzene and of ortho-, meta-, para-xylene) and of $C_9$ alkyl aromatics (generally from 5 to 25% by weight of propylbenzene, methylethylbenzenes and trimethylbenzenes), the absolute contents and relative proportions of the different components may vary with the cut points, the nature of the load sent to the reforming, the type of catalyst used and the operating conditions of the reforming; preferentially, aviation alkylate bases B3 applied within the scope of the present invention contain less than 1% by volume of benzene; in addition to the aromatic compounds, the reformate bases B3 may notably contain paraffins, iso- and n-paraffins, generally present in an amount of less than or equal to 5% by volume.

In the sense of the present invention, the base BI <<essentially consists of the compounds . . . >> means that said compounds . . . represent at least 70% by volume of said base Bi.

There would not be any departure from the scope of the invention, if the required toluene and/or isooctane and/or isopentane amounts were added to the mixture of bases B1, B2, B3 described above, in order to adjust the characteristics of the gasoline composition, in particular the MON, HV, vapor pressure (VP) and the distillation cut.

There would not either be any departure from the invention by adding other bases stemming from standard refining operations (for example, distillation of crude oil, catalytic cracking, hydrocracking, reforming, isomerization, alkylation methods, . . . ) and/or synthetic hydrocarbons such as notably those obtained by oligomerization of olefins, by Fisher-Tropsch synthesis, by methods of the BTL (biomass to liquid), CTL (gas to liquid) and/or GTL (gas to liquid) type from materials of natural and/or synthetic origin, of animal and/or plant and/or fossil origin.

Each base or cut entering the gasoline composition according to the invention, i.e. the bases B1 to B3 as well as any optional additional base, may have totally or partly been subject to a desulfurization and/or denitration treatment and optionally to a dearomatization treatment at any stage of its elaboration. For example, bases may be used which have been hydrotreated under more or less severe conditions (comprising hydrodesulfurization and/or saturation of the aromatic and olefinic compounds and/or hydrodenitration).

Aviation gasoline according to the invention advantageously has a sulfur content (measured according to ASTM D1266 or ASTM D2622°) of less than or equal to 500 ppm, preferably less than or equal to 100 ppm, or even less than or equal to 50 ppm, et still even more advantageously less than or equal to 10 ppm.

In order to meet the characteristics for example set by the ASTM D 910-07 standard, the aviation gasoline according to the invention may contain one or more additives, which one skilled in the art will easily be able to select from the numerous additives conventionally used for aviation gasolines. Let us notably mention, but not in a limiting way, additives such as antioxidants, anti-icing agents, antistatic additives, corrosion inhibitors/lubricating power enhancers, agents enhancing cold properties, tracer additives, coloring agents, detergents and mixtures thereof.

These additives are generally incorporated into the gasoline in amounts of less than 1,000 ppm. In the sense of the present invention, if one or more of the applied additives and incorporated into the gasoline contain one or more oxygen atoms, the gasoline will be considered as <<without any oxygenated compound>> according to the definition given above. As an example, mention may be made of the antioxidants selected from sterically hindered phenols (such as 2,6-di-t-butyl-4-methylphenol (BHT), 2,6-di-t-butyl-phenol and 2,4-di-methyl-6-t-butyl-phenol) usually applied in aviation gasolines.

The object of the invention is also the use of the composition defined earlier as a fuel for an aircraft piston engine.

EXAMPLES

The bases B1 (isopentane cut), B2 (aviation alkylate) and B3 (aviation reformate) are applied, the compositions of which are given in Table I below, the indicated amounts are expressed as volume percents.

TABLE I

| | | |
|---|---|---|
| B1 | Isopentane | 95 |
| | $C_4$ and $C_5$ paraffins | 99.2 |
| | Olefins | 0.8 |
| B2 | $C_8$ isoparaffins | ≤85 |
| | Isooctane | 45-55 |
| | 2,2,3-trimethylpentane | ≤5 |
| | $C_4$, $C_5$, $C_6$, $C_7$ and $C_{8+}$ isoparaffins | ≤15 |
| | Triptane | 0.1 |
| | $C_4$-$C_7$ n-paraffins | 0.8 |
| | Aromatics | — |
| B3 | Aromatics | 94.1 |
| | Benzene | 0.06 |
| | Toluene | 49 |
| | Xylenes | 29.2 |
| | $C_4$-$C_{8+}$ iso- and n-paraffins | 4.6 |
| | $C_8$ isoparaffins | 0.6 |

5 mixtures of the bases B1 to B3 described earlier are made and the MON, RON, HV, VP parameters are measured for the 5 mixtures noted as A to E.

The results are grouped in Table 2 below.

TABLE 2

| | A | B | C | D | E |
|---|---|---|---|---|---|
| B1 (volume %) | 17 | 10 | 12 | 20 | 18 |
| B2 (volume %) | 64 | 88 | 70 | 62 | 76 |
| B3 (volume %) | 19 | 2 | 18 | 18 | 6 |
| Isooctane (volume %) | 31.5 | 43.4 | 34.5 | 30.6 | 37.4 |
| MON-ASTM D2700 | 92 | 92.9 | 92.6 | 92.1 | 92.4 |
| RON | 98.3 | 95.6 | 98.5 | 97.9 | 96.3 |
| HV(MJ/kg)-ASTM D4529 | 43.47 | 44.41 | 43.53 | 43.56 | 44.17 |
| VP (kPa) | 46.3 | 43.8 | 38.9 | 48.1 | 48 |

The invention claimed is:

1. A lead-free aviation gasoline (AVGAS) having a Motor Octane Number (MON) comprised between 91 and 92.1 and without any oxygenated compound, the aviation gasoline being prepared by mixing of:

10 to 20% by volume of at least one isopentane cut B1:

62% to 88% by volume of at least one aviation alkylate base B2 essentially consisting of isoparaffins comprising 6 to 9 carbon atoms; and 1 to 22% by volume of at least one base of the aviation reformate type B3 essentially consisting of one of: alkylaromatics and aromatics, the mixture yielding a composition consisting essentially of:

from 10 to 22% by volume of isopentane (2-methyl-butane);

from 30 to 32% by volume of isooctane (2,2,4-trimethyl-pentane);

from 1.8 to 20% by volume of aromatics including 1 to 10% by volume of toluene; and up to 100% by volume of components(s) selected from:

C4-C5 isoparaffins other than isopentane,

C6-C9 isoparaffins other than isooctane and paraffins, iso-and n-paraffins other than isopentane and isooctane;

less than or equal to 500 ppm of sulphur, the sulpher content being measured according to the ASTM D1266 or ASTMD2622 standard; and less than 1000 PPM of at least one additive selected from: antioxidants, anti-icing agents, antistatic additives, corrosion inhibitors/lubricating power enhancer, agents enhancing cold properties, tracer additives, coloring agents, detergents and mixtures thereof;

and containing not more than 1% of triptane (2, 2, 3-trimethyl-butane) and not more than 4% of 2, 2, 3-trimethyl-pentane.

2. The aviation gasoline composition according to claim 1, consisting essentially of:

from 14 to 22% by volume of isopentane;

from 30 to 32% by volume of isooctane;

from 8 to 20% by volume of aromatics;

up to 100% by volume of component(s) selected from:

C4-C5 isoparaffins other than isopentrane,

C6-C9 isoparaffins other than isooctane, and paraffins, iso and n-paraffins other than isopentane and isooctane.

3. The aviation gasoline composition according to claim 1, consisting essentially of:

from 20 to 22% by volume of isopentane;

from 30 to 32% by volume of isooctane;

from 15 to 18% by volume of aromatics;

up to 100% by volume of component(s) selected from:

C4-C5 isoparaffins other than isopentrane,

C6-C9 isoparaffins other than isooctane, and paraffins, iso and n-paraffins other than isopentane and isooctane.

4. The aviation gasoline composition according to claim 1, the sulphur content of which measured according to the ASTM D1266 or ASTMD2622° standard is less than or equal to 100 ppm.

5. A method for preparing a gasoline composition according to claim 1, said method comprising mixing of:

10 to 20% by volume of at least one isopentane cut B1;

62 to 88% by volume of at least one aviation alkylate base B2 essentially consisting of isoparaffins comprising 6 to 9 carbon atoms; and 1 to 22% by volume of at least one base of the aviation reformate type B3 essentially consisting of one of: alkylaromatics and aromatic.

6. The method according to claim 5, in addition to bases B1 to B3, at least one other bases or cuts are added stemming from at least one of: standard refining operations and synthetic hydrocarbons, such as those obtained by at least one of: oligomerization of olefins, by Fisher-Tropsch synthesis, by methods of the BTL (biomass to liquid), CTL (gas to liquid) and GTL (gas to liquid) type from materials of at least one of: natural and synthetic origin, of animal and plant and fossil origin.

7. The method according to claim 5, further comprising at least one of: toluene, isooctane and isopentane, are added to the mixture of bases B1, B2 and B3, and to the optional other bases.

8. The aviation gasoline composition according to claim 1, wherein the gasoline is an aircraft piston engine fuel.

9. A lead-free aviation gasoline (AVGAS) having a Motor Octane Number (MON) comprised between 91 and 92.1, and without any oxygenated compound, the aviation gasoline being prepared by mixing of:

10 to 20% by volume of at least one isopentane cut B1;

62 to 88% by volume of at least one aviation alkylate base B2 essentially consisting of isoparaffins comprising 6 to 9 carbon atoms; and 1 to 22% by volume of at least one base of the aviation reformate type B3 essentially consisting of one of: alkylaromatics and aromatics, the mixture yielding a composition consisting essentially of:

from 10 to 22% by volume of isopentane (2-methyl-butane);

from 30 to 32% by volume of isooctane (2,2,4-trimethyl-pentane);

from 1.8 to 20% by volume of aromatics including 1 to 10% by volume of toluene;

at least one additive selected from: antioxidants, anti-icing agents, antistatic additives, corrosion inhibitors/lubricating power enhancer, agents enhancing cold properties, tracer additives, coloring agents, detergents and mixtures thereof;

up to 100% by volume of component(s) selected from:

C4-C5 isoparaffins other than isopentane,

C6-C9 isoparaffins other than isooctane and paraffins, iso- and n-paraffins other than isopentane and isooctane;

and containing not more than 1% of triptane (2,2,3-trimethyl-butane) and not more than 4% of 2,2,3-trimethyl-pentane.

* * * * *